United States Patent [19]

Signoretto

[11] Patent Number: 4,571,919

[45] Date of Patent: Feb. 25, 1986

[54] APPARATUS TO HANDLE PHOTOGRAPHIC DISC FILMS

[75] Inventor: Roberto Signoretto, Olmo di Martellago, Italy

[73] Assignee: Photo Engineering International s.r.l., Venice, Italy

[21] Appl. No.: 539,097

[22] Filed: Oct. 5, 1983

[30] Foreign Application Priority Data

Oct. 6, 1982 [IT] Italy ..... 84142 A/82

[51] Int. Cl.[4] ..... B65B 43/38; B65B 5/04

[52] U.S. Cl. ..... 53/266 R; 53/381 R; 414/411

[58] Field of Search ..... 53/581, 381 R, 244, 53/241, 381 A, 266 C, 266 R, 167; 414/411, 412

[56] References Cited

U.S. PATENT DOCUMENTS

| | | | |
|---|---|---|---|
| 1,735,609 | 11/1929 | Frederick | 53/581 X |
| 2,104,657 | 1/1938 | Bombard | 53/244 X |
| 2,233,466 | 3/1941 | Ayers | 53/244 X |
| 2,758,433 | 8/1956 | Birchler et al. | 53/581 |
| 3,001,349 | 9/1961 | Hoag | 53/581 |
| 3,359,704 | 12/1967 | Phillipson et al. | 53/244 X |
| 3,943,029 | 3/1976 | Mundt et al. | 53/266 C |

*Primary Examiner*—Horace M. Culver

*Attorney, Agent, or Firm*—Kimmel, Crowell & Weaver

[57] ABSTRACT

An apparatus for handling photographic disk films includes a light-proof casing having an entrance passageway for disk film cartridges and a remote light-proof disk film storage magazine. Also within the light-proof casing is a disk film cartridge transport unit to transfer disk film cartridges from the entrance passageway to the magazine. The transport unit includes a mechanism to prepare the disk film cartridges for opening by a blade in the light-proof casing during their movement and to orient the disk films for placement on a spit inside of the storage magazine.

11 Claims, 8 Drawing Figures

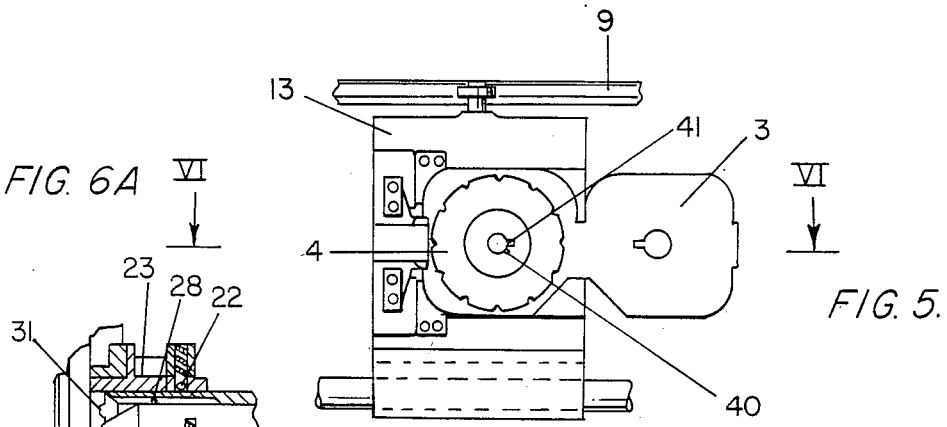
FIG. 5.
FIG. 6A
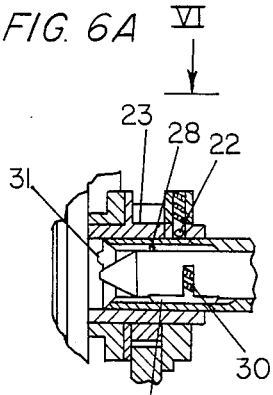
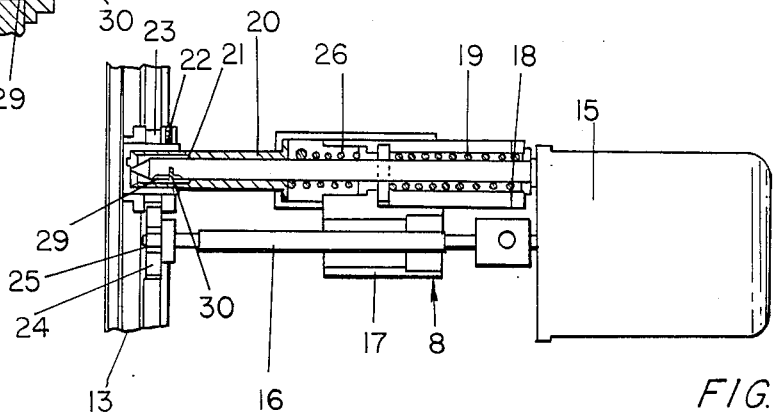
FIG. 6.
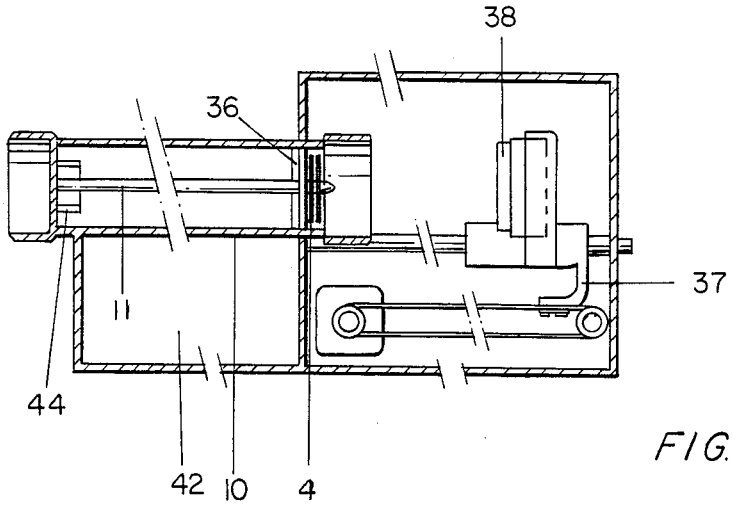
FIG. 7

APPARATUS TO HANDLE PHOTOGRAPHIC DISC FILMS

BACKGROUND OF THE INVENTION

The present invention relates to an apparatus for handling photographic disk films, and in particular an apparatus for automatically extracting a photographic disk film from its cartridge and inserting it into a light-proof magazine for transferring to the subsequent film processing operations.

Disk films having frames arranged in an annular array are well known. These films are held in light-proof cartridges which are inserted in a camera, and after exposure of the film the cartridges are removed from the camera and sent on for subsequent developing and printing operations to a film laboratory.

The centralized film developing and printing network creates a substantial work load for the photofinishing laboratory, and an ever-increasing need is felt for automating the film developing and printing procedures and reducing the time required to carry them out.

Among the operations carried out by the photofinishing laboratory are the extraction of the disk film from its cartridge and the placement of the extracted film in a magazine which, on becoming filled with disk film, is dispatched for subsequent processing.

An apparatus has already been proposed to automatically extract rolled films from the magazine in which they are wound; however, this apparatus is obviously not suitable for use to perform the same kind of operation on disk films, and this is due to their different shape and to the different problems this shape entails.

The object of the invention is to provide an apparatus for use by a photofinishing laboratory which automatically extracts disk films from their cartridges and inserts them in magazines which are then sent on to film developing and printing locations. The apparatus according to the invention functions rapidly and reliably in a light-proof environment. The apparatus for handling photographic disk films according to the invention comprises within a light-proof casing:

a passage way for the insertion of the cartridge containing the sensitized film to be extracted;

a light-proof magazine positioned inside said casing and provided with an internal spit into which films extracted from their respective cartridges are loaded one after the other;

a mobile blade substantially in a tangent relationship with the cartridge previously set up for opening;

a mobile spindle between a position facing said entry slot to receive the cartridge and a position facing said magazine to insert the film on its spit, said spindle being provided with a motor and a number of motions to hold the film during the opening of the cartridge, to eventually rotate it so as to bring it to the same angular position before inserting it on the spit and to carry carry out this insertion;

means for closing the magazine after it has been filled with a predetermined number of films.

According to the invention, a spindle or film cartridge transport unit may comprise a plate having a recess matching the shape of the disk film cartridge, the plate being provided with a hole coaxial with a central hole of the film cartridge and film, and means to retain the cartridge within the matching recess of the plate.

Advantageously, the spindle comprises a mobile shaft provided at its end toward the plate with means engaging a central hole of the film, and likewise comprising a coaxial sleeve mounted on the shaft, the sleeve having axial and rotational movements independently of the shaft.

According to the invention the spindle may comprise a threaded shaft axially acting on a slide to which the shaft coaxial with the sleeve is applied, said threaded shaft being mechanically coupled to said sleeve for its rotation.

According to the invention, a toothed wheel, linked to a toothed bush coaxial with the sleeve and provided with at least one sphere elastically engaging in longitudinal grooves in the external surface of this sleeve, may be fixed to the threaded shaft through a free wheeling device.

Advantageously the front end of the sleeve may have a small tooth engaging itself in a corresponding opening in the film.

According to the invention the shaft coaxial to the sleeve may be provided, near its front end, with an elastically radially directed retractable key, engaging itself in a corresponding notch in the film, said key being aligned with a corresponding rib in the spit when the spindle faces the magazine.

BRIEF DESCRIPTION OF THE DRAWINGS

FIG. 5 is a similar view showing the disk film cartridge open.

FIG. 6 is a horizontal section taken on line VI—VI of FIG. 5.

FIG. 6*a* is an enlarged cross sectional view of the area circled in FIG. 6.

FIG. 7 is a side elevation of a film magazine taken on line VII—VII of FIG. 1.

DETAILED DESCRIPTION OF PREFERRED EMBODIMENT

Figure 1:
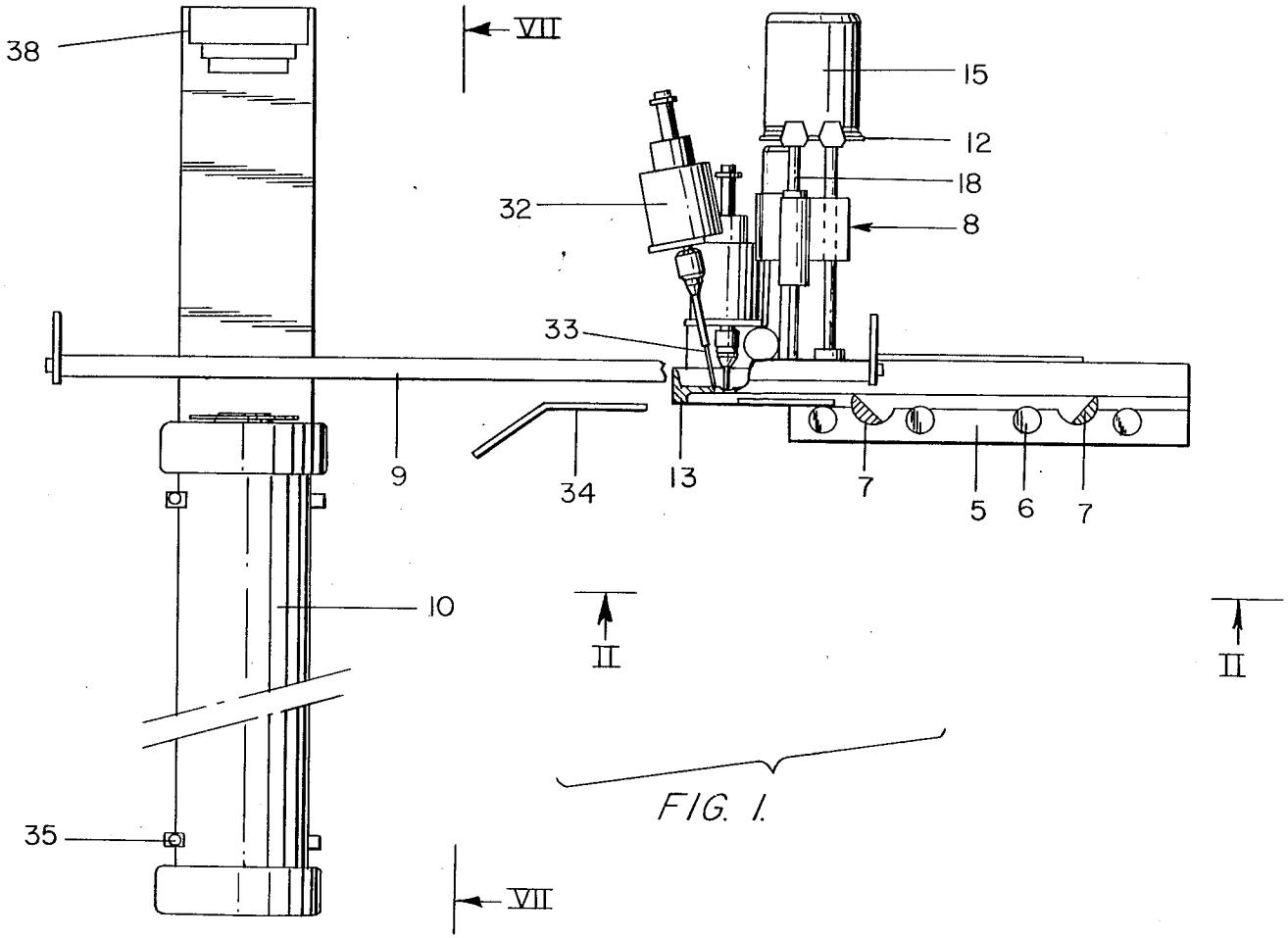
FIG. 1 is a plan view of an apparatus for handling disk films according to the invention.
Figure 2:
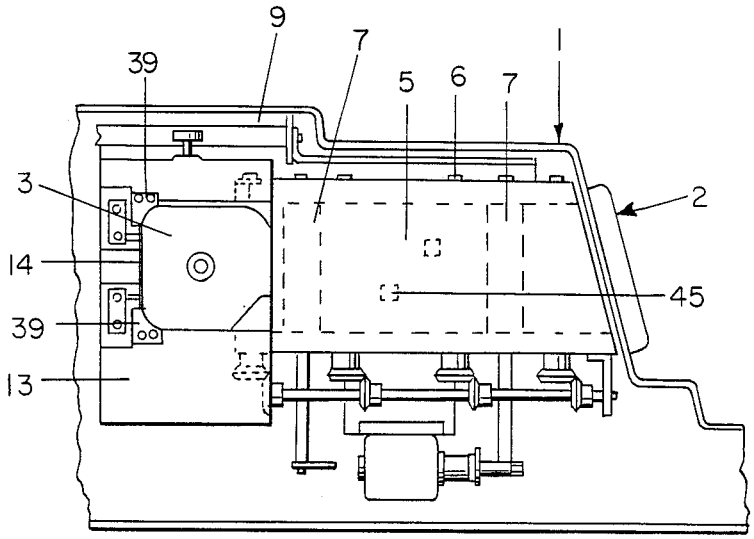
FIG. 2 is an enlarged fragmentary side elevation of the apparatus taken on line II—II of FIG. 1.
Figure 3:
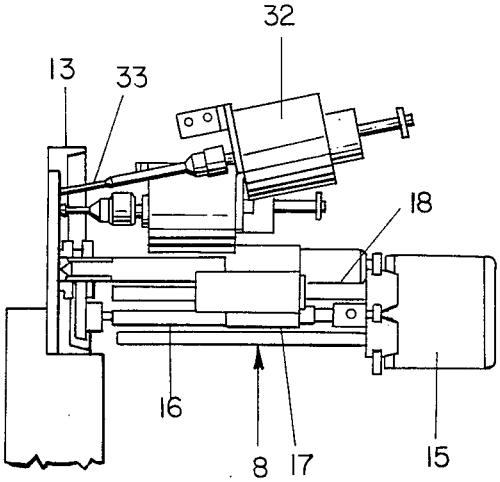
FIG. 3 is a side elevation of a spindle or transport unit and associated elements.
Figure 4:
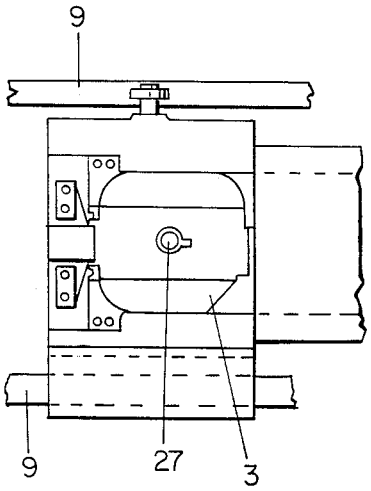
FIG. 4 is a fragmentary elevational view similar to FIG. 2 showing a closed disk film cartridge in place.

As can be seen from the drawing figures, the apparatus according to the invention is completely housed inside a light-proof casing 1, provided with a slot 2 for the insertion of the cartridge 3 containing the disk film 4 to be developed. The slot 2 enables external communication through a narrow passage 5 along which the cartridge 3 is made to advance by means of transporting rollers 6. The passage 5 is provided with a pair of light-proof revolving gates 7 positioned at a distance slightly greater than the width of the cartridge 3, so as to enable them to be closed even when the cartridge is placed between them. These gates are activated by means of traditional systems which have not been illustrated in the drawings for simplicity sake, and their activation is conditioned by enabling sensors, for example photocells, which prevent a gate from opening in cases where the other gate is not perfectly closed.

Inside the casing 1 there is a spindle 8, or transport unit movable along slides 9 parallel to the longitudinal axis of the passage 5 between two extreme positions, one facing the internal end of this passage 5, the other facing a cylindrical magazine 10 housing a rod 11 or "spit", into which the films 4 to be developed, extracted from the respective cartridge 3 are inserted one by one. The translation of the spindle 8 between the two extreme positions is obtained with traditional toothed belt systems (not illustrated in the drawings).

The spindle 8 comprises a frame 12 provided, in the part near the passage 5, with a plate 13 supporting the cartridge 3. With this aim an imbedded imprint 14 or recess is formed in the said plate 13, forming the front and side support for the cartridge 3. On the frame 12 also there is an electric motor 15 mounted on the side of the plate 13 opposite the recess 14.

The shaft of this motor 15 includes a threaded extension shaft 16 with which a transporting axial slide 17 of a shaft 18 is threadedly engaged. Between the rear end of the shaft 18 and the slide 17 there is a coil spring 19 keeping the shaft biased fowardly with respect to the slide 17.

On the outside of the shaft 18 there is a cylindrical sleeve 20. This sleeve is provided on its external surface with a number of grooves 21 running along parallel to its longitudinal axis and, in these grooves, two spheres 22 are elastically engaged, mounted on a toothed bush 23 coupled with a toothed wheel 24. This wheel is mounted by means of a free wheeling device 25 at the front end of the threaded shaft 16, substantially near the plate 13.

Between the sleeve 20 and the shaft 18 there is a coil spring 26 having a constant tension which is less than that of spring 19 and keeping elastically the sleeve 20 in its rear position. Both this shaft 18 and the sleeve 20 can protrude from the plate 13 through a circular hole 27 which is exactly in the centre of the recess 14 and therefore in coaxial alignment with the central hole of the film 4.

The shaft 18 has a pointed tip and around this tip there is a pair of spheres 28 protruding from its side surface and being elastically retractable in a radial direction. Furthermore in the shaft 18 there is a key 29 which is biased outwardly by a spring 30. The action of this spring is controlled by the sleeve 20 in the sense that for certain axial positions (rearward) of the sleeve with respect to the shaft 18, the key 29 may protrude from the side surface of the shaft 18 whereas for other positions (forward) the sleeve prevents the exit of the key.

Furthermore the front end of the sleeve 20 is provided with a tooth 31, whose function will be clarified in the description of the operating of the apparatus.

Two electromagnets 32 are also fixed to the spindle frame 12 on the same side thereof as the electric motor 15. These two electromagnets 32 activate two pins 33 protruding from the plate 13 precisely near two pressure areas on cartridge 3 when the cartridge is housed within the recess 14 in order to trigger the partial separation of the two half sections embodied in the cartridge 3.

In an intermediate position of the spindle or transport unit 8, the apparatus comprises a fixed blade 34 which engages the cartridge 3 traveling with the spindle and causes separation of the outer half section of the cartridge shell from the inner half section held within the recess 14 of plate 13.

Furthermore the apparatus according to the invention comprises a cylindrical disk film magazine 10 near the spindle position at a remote position from the entry slot 2. This magazine is removably mounted on two clamps 35 and houses within it the spit 11 which is precisely aligned with the shaft 18 of the spindle 8 when the latter has stopped in its end position. The axial position of the spit 11 is ensured at one end by a supporting bush 44 located at the bottom of the magazine 10 and at the other end by a septum clutch 36 mounted on the spit 11 having a diameter slightly smaller than the internal diameter of the magazine 10.

Coaxially facing the magazine 10 and at a distance from its opening, greater than the dimensions of the spindle 8, there is a support 37 for a light-proof closure cap 38 for the magazine. Traditional movement devices are used to shift the support 37 from a waiting position (away from the magazine 10) to a position to fit the cap 38 onto the magazine.

Furthermore the apparatus comprises a number of automatic control and activation devices ensuring that the various operation phases run correctly. These will be noted from time to time in the course of the following specification.

The operating of the apparatus is the follows:

A cartridge 3 containing the disk film 4 to be developed is brought up along side the slot 2. During this phase the revolving gates 7 are closed and ensure a complete light-proof environment which will protect the films which are already present in the casing 1. The advance of the cartridge 3, performed by the rollers 6, triggers the closing of the external revolving gate 7 as soon as the cartridge 3 has gone past the external revolving gate. The latter closes and the internal gate 7, FIG. 1, subsequently opens letting the cartridge 3 pass and enabling the positioning of the cartridge 3 in the recess 14 in the plate 13. In their passage between the two revolving gates, the bar codes on the cartridge 3 are read through two windows 45 cut out in the side wall of the passage 5.

The stable positioning of the cartridge 3 in the recess 14 is ensured by two locator plates 39 which hold the internal half section of the cartridge 3 adhering to the plate 13.

After the cartridge 3 is correctly positioned in the recess 14 the motor 15 is powered on. The latter rotates the threaded shaft 16 which advances the slide 17 and axially forces the shaft 18 to protrude from the hole 27 of the plate 13 and advance with its pointed end inside the corresponding film hole.

The advancement of shaft 18 causes the spring engagement of the film 4 by the sphere 28 whereas the sleeve 20 having a diameter larger than that of the center hole in the disk film 4 remains retracted with the spring 26 compressed. This retracted position of the sleeve 20 would leave this key 29 free to elastically protrude from the shaft body 18; normally, however, this does not occur because the film 4 itself prevents this protruding.

At the same time the threaded 16 shaft rotation triggers the toothed wheel 24 rotation and that of the toothed slide 23. The latter triggers the rotation of the sleeve 20 due to action between the spheres 22 and the grooves 21.

The sleeve 20 continues to rotate until its forward end tooth 31 registers with an opening 40 in the disk film 4, FIG. 5. The tooth 31 enters the opening 40 under influence of the coil spring 26 and begins to drive the disk film in rotation around the shaft 18 until a notch 41 in the disk film registers with the key 29. At this point, the spring-loaded key can enter the notch 41 and prevents further rotation of the sleeve 20 and disk film 4, triggering disengagement of the spheres 22 from the grooves 21.

The operations now described occur during movement of the spindle 8 from its position at the passage 5 to its position adjacent to the magazine 10. At the beginning of this spindle movement, the electromagnets 32 are energized to thrust the pins 33 against the outer half section of the film cartridge shell 3 being held in the plate recess 14 by plates 39. This initiates the opening of the film cartridge 3. Thereafter, further movement of the spindle 8 causes the film cartridge 3 to be engaged by the blade 34 which completes the opening of the cartridge as illustrated in FIG. 5.

When the shaft 18 is exactly facing the spit 11 of the magazine 10, the spindle 8 comes to a halt and a further advance of the shaft 18 is counteracted by the spit 11. At this point, since the slide 17 keeps on advancing, the spring 19 yields and the slide 17 movement with respect to the shaft 18 triggers slide contact with the sleeve 20 and its subsequent axial thrust. The sleeve's 20 axial movement with respect to the shaft 18 in turn causes the sleeve 20 to separate from the disk film 4, which film, while overcoming the resistance of the spheres 28, leaves the shaft 18 and is slipped onto the spit 11 which is coaxially aligned with the shaft 18. The spit 11 has a longitudinal rib 42, FIG. 7, aligned with the key 29. The advance of the disk film 4 along the spit 11 pushes all of the disk films on the spit together with the septum 36 to move along the spit toward one end of the magazine 10. The purpose of the septum 36 is to center and stabilize the forward end of the spit.

After each film 4 is placed on the spit 11, the spindle 8 or transport unit begins its return travel toward the passage means 5, its drive motor 15 then operating in reverse. The slide 17 retreats along with the shaft 18 and the sleeve 20. The sleeve 20 does not rotate at this time due to the action of the free wheeling device 25.

When the shaft 18 and the sleeve 20 have retracted from the hole 27 in plate 13, the open film cartridge 3 is no longer held and can fall into a collecting bin, not shown. The separating of the cartridge 3 from the plate recess 14 can be aided by a spring, not shown.

When the spindle 8 returns to its end of run position corresponding to the passage 5, it can initiate a new operative cycle which carries another film into the magazine 10 and so on until the latter is full. The total filling of the magazine 10 is controlled by a counter which reaches a predetermined number, then draws a support 37 to the magazine 10 and fixed the closure 38.

At this point it is possible to open the casing 1, remove the magazine 10, reposition another empty magazine 10 and its accompanying cover 38 and put the unit back into operating condition again.

I claim:

1. An apparatus for handling photographic disk films comprising a light-proof casing, an entrance passageway for closed disk film cartridges on the light-proof casing, a light-proof storage magazine for disk films in the light-proof casing and spaced from said entrance passageway, said magazine having an internal spit onto which disk films are placed one after another following removal of the disk films from their cartridges, a cartridge opening blade in the path of movement of disk film cartridges between the entrance passageway and said magazine, a disk film cartridge transport unit movable along a linear path between said entrance passageway and magazine and including a drive motor and additional power means to act on each disk film cartridge during transport to prepare it for opening by said blade, and resiliently biased rotary disk film engaging and supporting means on said transport unit and being operable to take each disc film from its opened cartridge and index the film for proper placement on said spit of the magazine when the transport unit has moved to a location adjacent to the magazine, and means for closing said light-proof storage magazine after it has been filled with a predetermined number of disc films.

2. An apparatus for handling photographic disk films as defined in claim 1, and a pair of spaced rotary light-proof gates within said entrance passageway and being spaced apart by a distance greater than the width of each disk film cartridge, and means on the entrance passageway to propel disk film cartridges therethrough.

3. An apparatus for handling photographic disk film as defined in claim 1, and said transport unit including a plate having a recess receiving each disk film cartridge leaving the entrance passageway and being shaped to fit said cartridge and having a hole which is coaxially aligned with a central hole of the cartridge and a hole of the disk film therein, and means on said plate engaging each cartridge to retain it in said recess during transport toward said blade and said magazine.

4. An apparatus for handling photographic disk films as defined in claim 3, and said resiliently biased rotary disk film engaging and supporting means including a pointed shaft engageable with the center hole of each disk film, and a coaxial sleeve mounted on said shaft and moving axially and rotationally independently of said shaft and having a leading end tooth adapted to drivingly engage an opening of each disk film.

5. An apparatus for handling photographic disk films as defined in claim 4, and said transport unit additionally including a screw-threaded rotational shaft spaced from and parallel to the pointed shaft, and a slide threadedly engaged with the threaded shaft and being connected to said pointed shaft, the screw-threaded rotational shaft being drivingly connected to said sleeve to rotate the sleeve on the pointed shaft.

6. An apparatus for handling photographic disk films as defined in claim 5, and a spring connected with the pointed shaft and slide and biasing the pointed shaft in a forward direction relative to said plate.

7. An apparatus for handling photographic disk films as defined in claim 6, and a key held on the pointed shaft near its leading end and being resiliently biased radially outwardly from the pointed shaft and being engageable in a notch of each disk film, and said key being adapted for longitudinal alignment with a longitudinal rib on said spit when the transport unit is adjacent to said magazine.

8. An apparatus for handling photographic disk films as defined in claim 1, and said additional power means comprising at least an electromagnet on said transport unit having a pin adapted to engage one side wall of each disk film cartridge to partially open the cartridge in preparation for complete opening by said blade.

9. An apparatus for handling photographic disk films as defined in claim 7, and another spring connected between said pointed shaft and sleeve and biasing the sleeve forwardly on the pointed shaft, the tension of said another spring being less than the tension of said spring connected with the pointed shaft and slide.

10. An apparatus for handling photographic disk films comprising a light-proof casing having an entrance passageway for closed disk film cartridges with the cartridges disposed on edge within the passageway, a light-proof storage magazine for disk films within the light-proof casing and spaced from the entrance passageway, said magazine having an axis substantially perpendicular to a plane occupied by each cartridge while the latter is on edge and the magazine having an internal center longitudinal spit on the axis of the magazine onto which disk films are placed in stacked relationship following removal of the films from their cartridges, a cartridge opening means fixed along the path of movement of the disk film cartridges between the entrance passageway and said magazine, a disk film cartridge transport unit and means to guide such unit on a linear path between the entrance passageway and magazine, power means on said transport unit to propel the unit along said means to guide such unit, and cooperative reciprocating and rotational elements on the transport unit and being engageable with each disk film to support the disk film and rotate it to a position where the disk film can be transferred onto said spit, the spit and each disk film having cooperative interengaging guide means, and means for closing the light-proof storage magazine after it has been filled with a number of disk films.

11. An apparatus for handling photographic disk films as defined in claim 10, and said last-named means comprising a light-proof cap for said magazine, and guide and movement means for said cap to shift the cap toward and away from closing relationship with said magazine.

* * * * *